US006193081B1

(12) United States Patent
Ewing

(10) Patent No.: US 6,193,081 B1
(45) Date of Patent: Feb. 27, 2001

(54) RACK FOR HOLDING CYLINDRICAL ARTICLES

(76) Inventor: Timothy L. Ewing, 2126 P St. NW. #128, Washington, DC (US) 20037

( * ) Notice: Subject to any disclaimer, the term of this patent is extended or adjusted under 35 U.S.C. 154(b) by 0 days.

(21) Appl. No.: 09/349,083

(22) Filed: Jul. 8, 1999

(51) Int. Cl.[7] ..... A47F 7/00; B65D 85/14

(52) U.S. Cl. ..... 211/70.6; 211/60.1; 211/49.1; 206/277

(58) Field of Search ..... 211/70.1, 70.6, 211/60.1, 49.1; 206/277, 384, 443

(56) References Cited

U.S. PATENT DOCUMENTS

| | | | | |
|---|---|---|---|---|
| D. 332,670 | * | 1/1993 | McFarland | D28/38 |
| 1,922,233 | * | 8/1933 | Cooney | 206/277 |
| 2,313,620 | * | 3/1943 | Brunner | 211/70.1 |
| 4,191,415 | * | 3/1980 | Frei | 206/443 X |
| 5,881,878 | * | 3/1999 | Faccioli et al. | 206/443 X |
| 6,036,032 | * | 3/2000 | Moscatelli | 211/60.1 |

* cited by examiner

*Primary Examiner*—Robert W. Gibson, Jr.
*Assistant Examiner*—Erica B. Harris

(57) ABSTRACT

A holder for cylindrical articles is provided that comprises an open frame design. The slanted, article supporting base extends somewhat further than the length of the articles to be stored allowing for the retention of potential spillage of material from the articles while in an upright position. Attached to the base are two side panels. The first side panel includes a slot for permitting the inserting and withdrawing of articles that are stacked upon the base. Additionally, the first side panel may contain a means of closure such as a gate to insure retention of the articles in the holder regardless of the position of the holder. The opposing side panel has a smaller slot to receive the narrow end of the articles that are inserted into the holder thereby retaining the articles, and, with the assistance of the slanted base, effectively sliding the articles toward this second panel. Connecting the side panels is a top panel that is separated from the base by a distance that determines the number of articles that can be stored in the holder. The top panel is designed with a means of allowing for the portability of the holder and, may contain a means linking two or more racks. A back panel links the aforementioned panels and extends somewhat further than the length of the article to be stored, allowing for the retention of potential spillage from the articles while in a horizontal position. Additionally, the holder may contain mounting holes permitting the rack to be mounted in a variety of positions while allowing for its removal for the portability of the holder and its contents. Further, the rack may accommodate items associated with the application of the contents of the tubes.

2 Claims, 8 Drawing Sheets

RACK FOR HOLDING CYLINDRICAL ARTICLES

BACKGROUND

Adhesives and caulkings are commonly sold in tube type containers. This type of tube is typically cylindrical in fonn with a narrow elongate spout at one end of the tube. The spout is cut to open, allowing for the dispensing of the product through the spout, upon the application of pressure to the base end of the cylinder. A variation of this means of packaging is the tubular package designed to be dispensed by hand pressure applied directly to the tube. Such a tubular package has the end folded creating a "V" shape, such tubes can not be stored upright. As the tubular containers of the type utilized for caulking and adhesive are cylindrical, they can present problems of storage for the user. The tubes are easily knocked over, and, have a tendency to roll on a horizontal surface. If stored in a box or bucket, it is difficult to determine specific contents of a particular tube due to the fact of the contents being identifiable primarily by label only.

There are many types of caulkings and adhesives available in tube type containers, each designed for a specific use and application. For example, there are silicone sealants in a variety of colors, butyl rubber caulkings in an offering of colors, acrylic formulas in colors, adhesives of many types, tar based sealants, fire resistant sealants, specific applications for glaziers, plumbers, painters, electricians, etc. For this reason, is not uncommon for a construction worker, or repairperson, professional or amateur, to require the use of a number of tubes of these products, and to have them available to move to the required work areas.

There is also a need to have the contents readily identifiable and accessible whether the holder is mounted in a home shop, a jobsite, or moving regularly from one work area to another. If in transit, there is a need to ensure retention of the products in the holder regardless of the position of the holder. Such a means may be a gate of one design or another.

Relative to the type of contents and air temperature, there is tendency for these tubes to leak, potentially creating yet another problem. Therefore, there is a need for a holder that addresses this problem with a means of retention of potential spillage to protect surrounding areas.

Currently manufacturers of caulkings and adhesives have few options for marketing their products. These sealants and adhesives are typically sold as an individual tube only, or occasionally as a group of tubes of the same type of product shrink-wrapped together. As there are no holders for this type of tube, manufacturers are not able to provide the users of their products with an inexpensive portable holder in which to store their products. Also lacking is a means to bulk package these products in a portable holder that provides an attractive, value-added feature to organize and store these products upon purchasing!

For the aforementioned reasons there is a demand for a holder for tube type articles that will allow the user to simply and quickly view the contents to ascertain content, and to access the articles independent of one another. Additionally, there is a demand for a holder for tube type articles that will ensure retention of the articles in the holder whether the holder is secured to a surface or in transit, while eliminating the potential of product spillage. Furthermore, there is a demand for a holder that will be inexpensive to manufacture allowing manufacturers of caulkings and adhesives to package their products in such a way as to provide a value added feature, distinguishing their products from others while offering their products as a convenient multiple pack.

SUMMARY

The present invention is directed to a holder for tube shaped articles that satisfies the aforementioned needs. A holder for tube shaped articles having features of the present invention comprises an open front frame design with a slanted, article-supporting base somewhat longer than the articles to be stored. This slant of the base maintains a downward positioning of the articles to allow removal of articles regardless of their position in the holder. Attached to the base are two side panels. The first side panel includes a slot for permitting the inserting and withdrawing of articles that have been stacked above the base. This side may include a gate or other means of effectively keeping the articles in the holder regardless of the position of the holder. The second side panel has a smaller slot to receive the spouts of the articles that have been inserted into the holder while not allowing passage of the base of the articles. Connecting the side panels is a top panel with a means of allowing for portability of the holder. The top panel is separated from the base at a distance that determines the number of articles that can be stacked within the holder. The holder may contain a means of joining two or more holders by linking the top of one holder to the base of another. The aforementioned sides, the top, and the base are joined by a back panel which extends somewhat further than he length of the articles to be stored, thereby providing for the retention of potential spillage from the articles stored within the holder. Additionally, the holder may contain mounting holes to permit the mounting of the rack in a number of positions, while allowing for the ease of removal to permit portability of the holder.

These and other features, aspects, and advantages of the present invention will become more substantial and clearly understood with regard to the following description, appended claims, and accompanying drawings.

DETAILED DESCRIPTION

Figure 1:
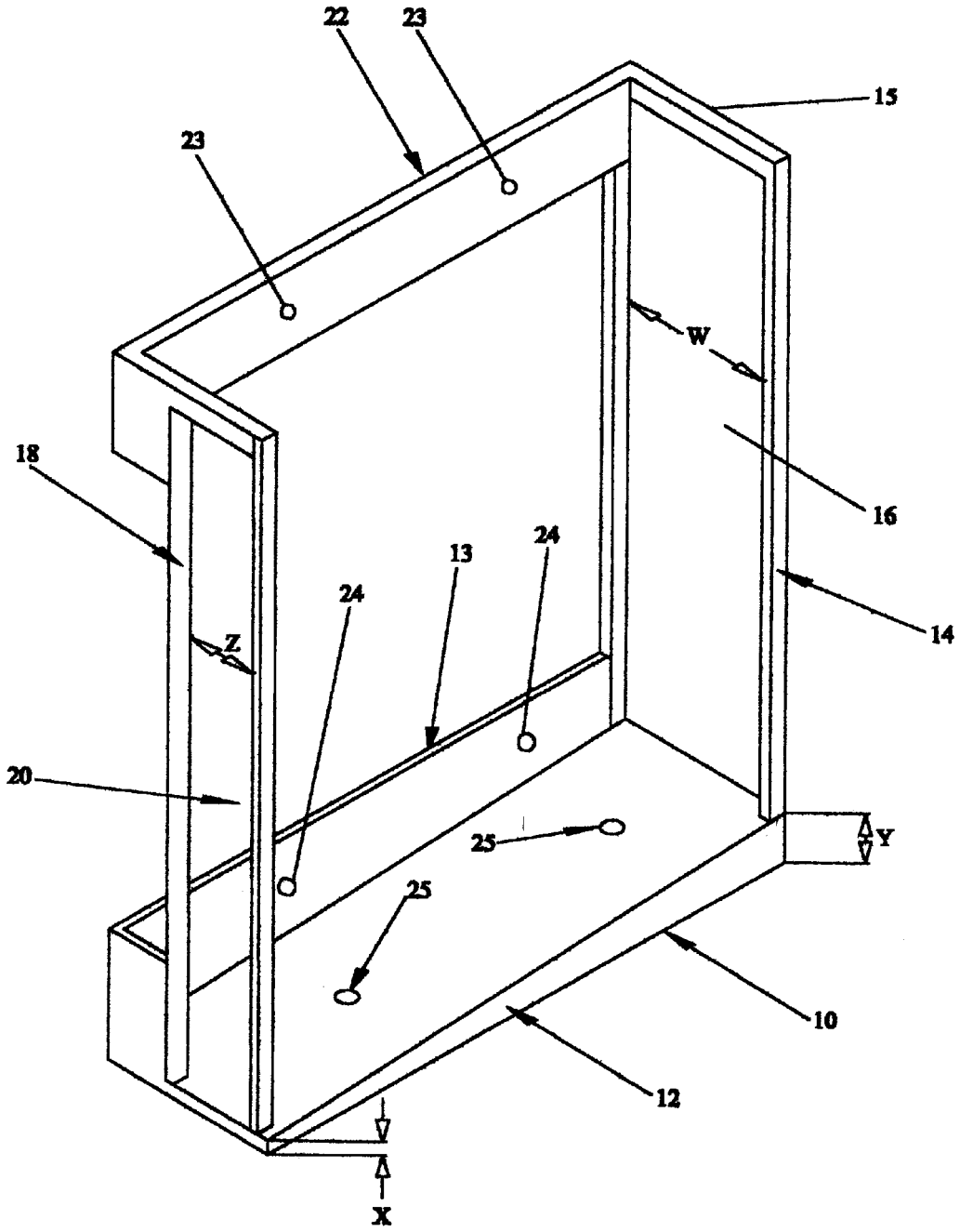
FIG. 1 is a perspective view of one form of the holder embodying principles of the present invention.
Figure 2:
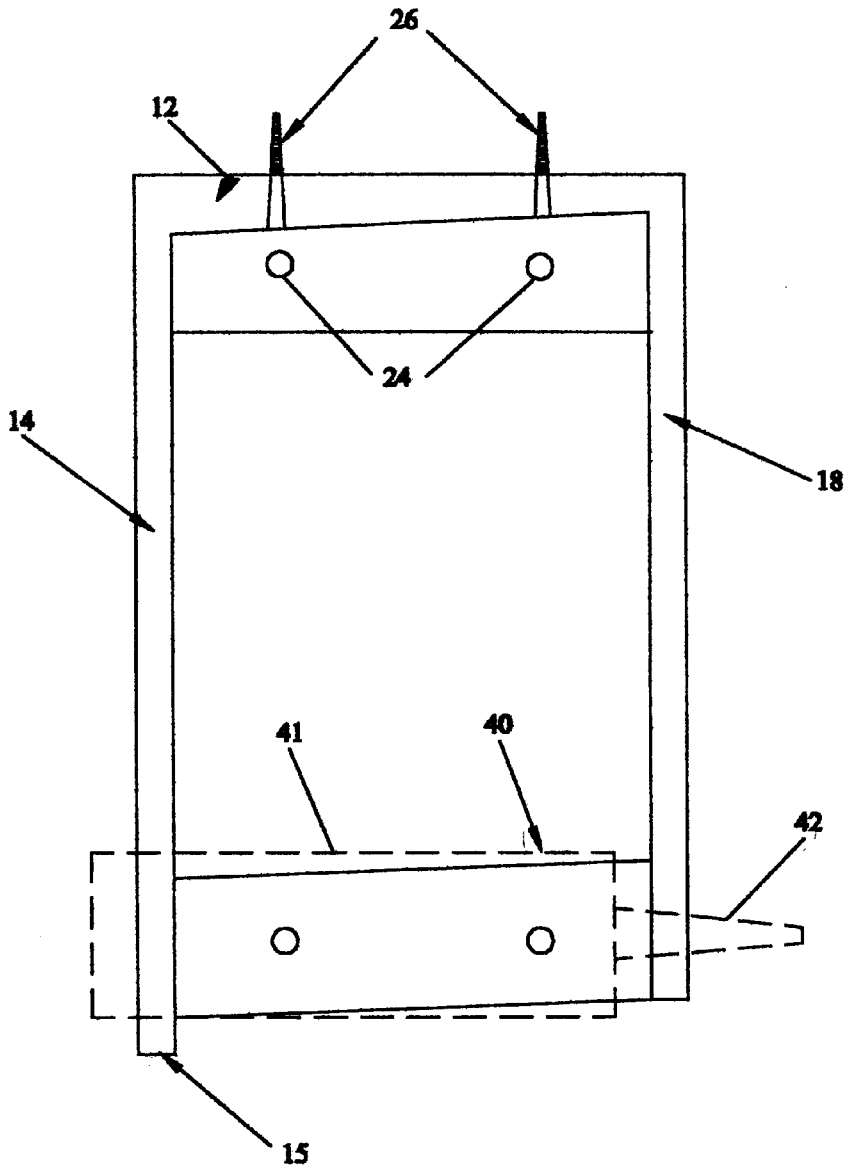
FIG. 2 is a front elevation of the holder of FIG. 1 with holder inverted for suspended mounting.
Figure 3:
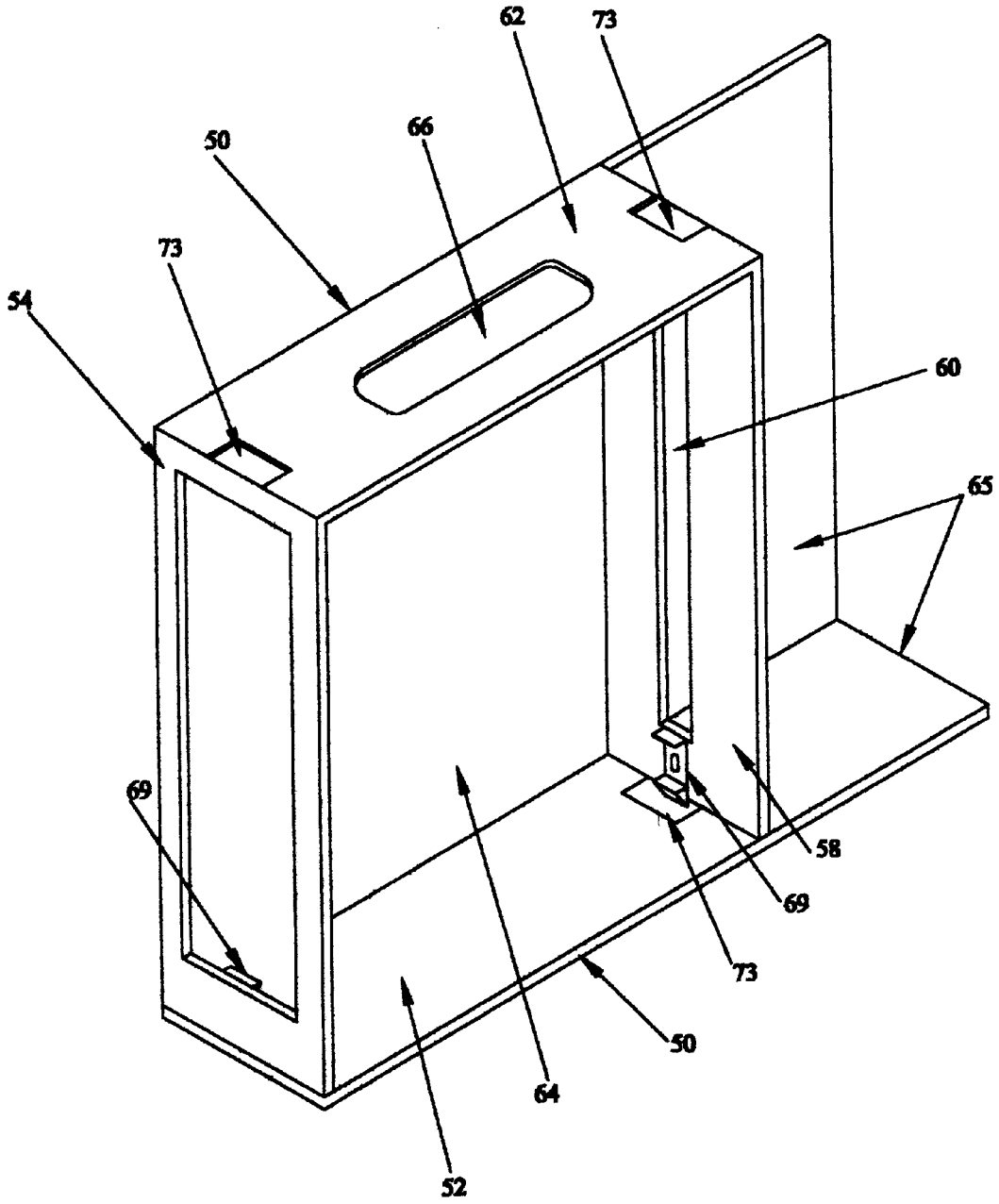
FIG. 3 is a perspective view of a second form of the holder embodying the principles of the present invention.
Figure 4:
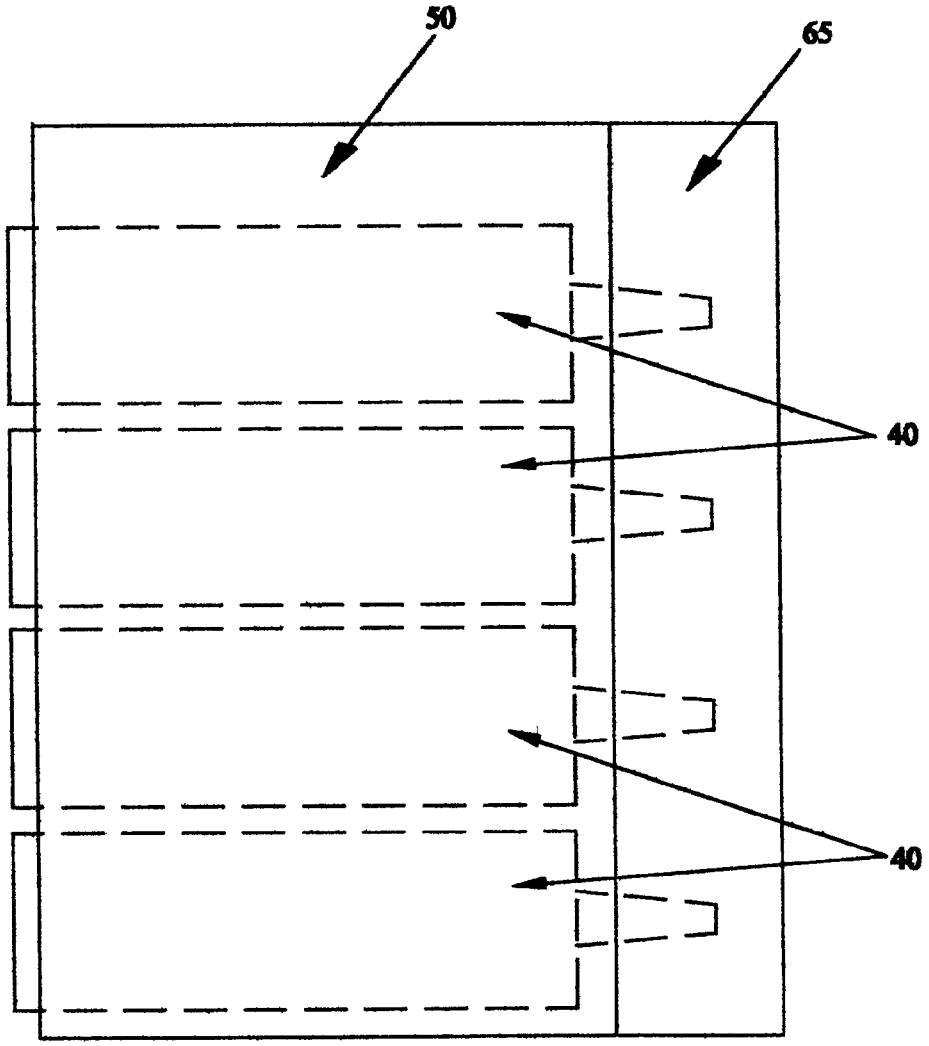
FIG. 4 is a front elevation of the holder of FIG. 3 shown with a plurality of tube shaped articles retained in the holder.
Figure 5:
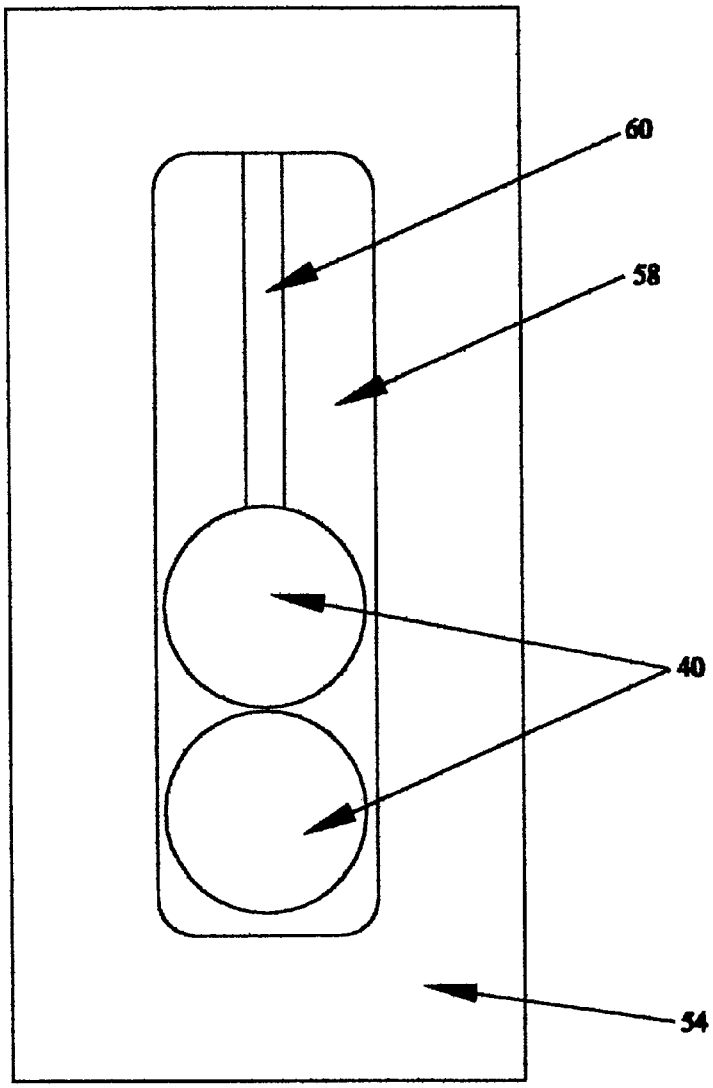
FIG. 5 is a side elevation of the holder of FIG. 3 shown with tubes supported on the base, and within the slot of the first panel of the holder.

Two forms of the holder are shown in the accompanying drawings. A first form is shown in FIGS. 1 and 2, and a second form is shown in FIGS. 3, 4, and 5. FIGS. 6 through 10 represent the inclusion of additional features. For the sake of the clarity of understding of the basic and unique principles inherent in the present invention, these several subsidiary features have been introduced via separate drawings.

The function of either holder is to contain a group of similar articles such as tubes of caulking or adhesive. The products in these tubes are typically used by construction workers, repair persons and the handyperson, amateur or professional. For the purposes of later description, each of the articles 40 will be said to include a cylindrical body 41, and a spout 42.

Both forms of the holder 10 and 50 take the form of an open-front frame. Each holder is typically of a one-piece injection molded plastic construction yet may be constructed of other materials as well. For example, steel construction provides increased strength and life of the holder or, allowing for minimal cost and life span of the holder, a material such as a corrugated cardboard may be employed.

The holder 10 as shown in FIGS. 1 and 2 comprises an article supporting base 12 that has a flat bottom surface and a slanting top surface as illustrated by the comparison between thickness "x" and "y". Attached to the base 12 are two opposing side panels 14 and 18. Side panel 14 includes a longitudinal slot 16 which permits the inserting and withdrawing of tube shaped articles. The length of slot 16 would typically permit the stacking of several articles 40 within the holder 10. The side panel 14 has a bridge member 15 that serves as an upper limit for the articles stacked in the holder 10 of FIG. 1.

Opposite side panel 14 is opposing side panel 18 attached to the slanted base at the narrow end. Side panel 18 contains article-retaining means 20 that comprises a longitudinal slot. Article retaining means 20 is sized so that the spout 42 of a caulking or adhesive tube, or similar article, will pass through the slot 20, yet will prevent the body of such an article from passing through the slot. The slanted base 12 is designed to slide the articles toward slot 20, helping to retain the articles in the holder as an article in the stack is removed and, to allow the articles above to retain their orientation in the holder upon completion of the act of removal. Some tube type articles are designed to be used in a trigger-operated dispenser that pushes the material within the tube toward the spout 42. The tubes become more weighted toward the spout end as the tubes are opened and utilized. This phenomenon also contributes toward the orientation and retention of the tubes in the holder as the more weighted end tends naturally to slide toward the slot 20.

A top panel 22 joins the first side panel 14 and the second side panel 18. As is noted in FIG. 1 the holder 10 is open-fronted to permit the entirety of each tube to be viewed without obstruction, upon the rotation of the tube within the holder. It is also noted that articles retained in the holder can be withdrawn from the holder independent of other articles in the holder.

The base 12 as shown in FIG. 1 is shown with an extension 13. The base extension 13 along with top panel 22 combine to provide the holder 10 with a back panel. In the design of FIG. 1 the back panel would be comprised of the two sections 13 and 22 separated by a space which permits extended viewing range of the articles in the holder. It is understood that the two sections comprising the back panel in FIG. 1 may be replaced with a single full panel. Both top panel 22 and extension 13 are typically provided with mounting holes 23 and 24. These holes provide the user the opportunity to mount the holder in a variety of locations such as in a workshop, a vehicle such as repair truck or van, or a construction site. The mounting holes are formed so as to allow the removal of the holder from it's place of mounting to allow the user the option of portability to other areas as needed.

The base mounting holes 25 provide the user the option of mounting the holder with the base resting on a horizontal surface, as well as in an inverted orientation as in a suspended mounting as shown in FIG. 2. It is noted that the features described above relative to a non-inverted mounting position, are all present in the inverted mounting position.

FIGS. 3, 4, and 5 show another form of the holder of the present invention. The holder as represented by these drawings embodies the same basic principles and method of use and operation of the holder in FIGS. 1 and 2 with the inclusion of additional features as noted. FIG. 3 shows a perspective view of holder 50. Holder 50 comprises an open-fronted frame having an article supporting base 52, a first side panel 54, a second side panel 58, a top panel 62, and a back panel 64.

Base 52 is slanted in design with a narrow end and a thicker end. Attached to the thicker end is first side panel 54. The first side panel includes a longitudinal slot 56 permitting the inserting and withdrawing of tube shed articles. Opposite the first side panel 54 is a second side panel 58, which is attached to the narrow end of the base 52. Second side panel 58 contains article retail means 60, which is in the form of a longitudinal slot allowing for the retention of the narrow or spout end of the article in slot 60, while not allowing the passage of the base of the article.

The back panel 64 shows an extension 65 of the surface of the panel somewhat further than the narrow ends of the articles to be stored allowing for the retention of potential spillage from the tubes. This extension 65 is shown on the base 52 as well allowing this feature whether in an upright position or laying flat. The top panel 62 is shown with a cutout 66 which accommodates the human hand allowing for the portability of the holder. Additional means of accomodating this purpose are implied though not illustrated herein.

FIG. 4 shows a front view of the holder including several cylindrical articles. The downward orientation of the articles becomes apparent in this view and the ease of identification of contents via the open-front frame. FIG. 5 shows a side view of the holder including several cylindrical articles.

Figure 7:
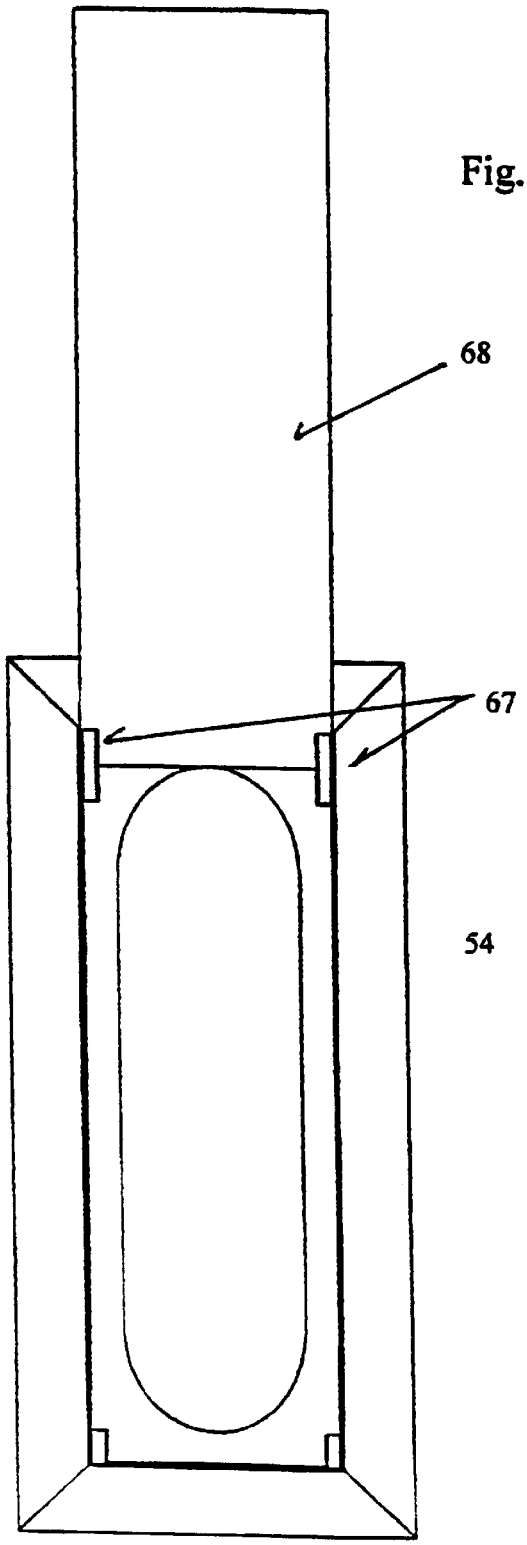
FIG. 7 is a side elevation of a means of closure to ensure retention of articles in holder regardless of position.
Figure 6:
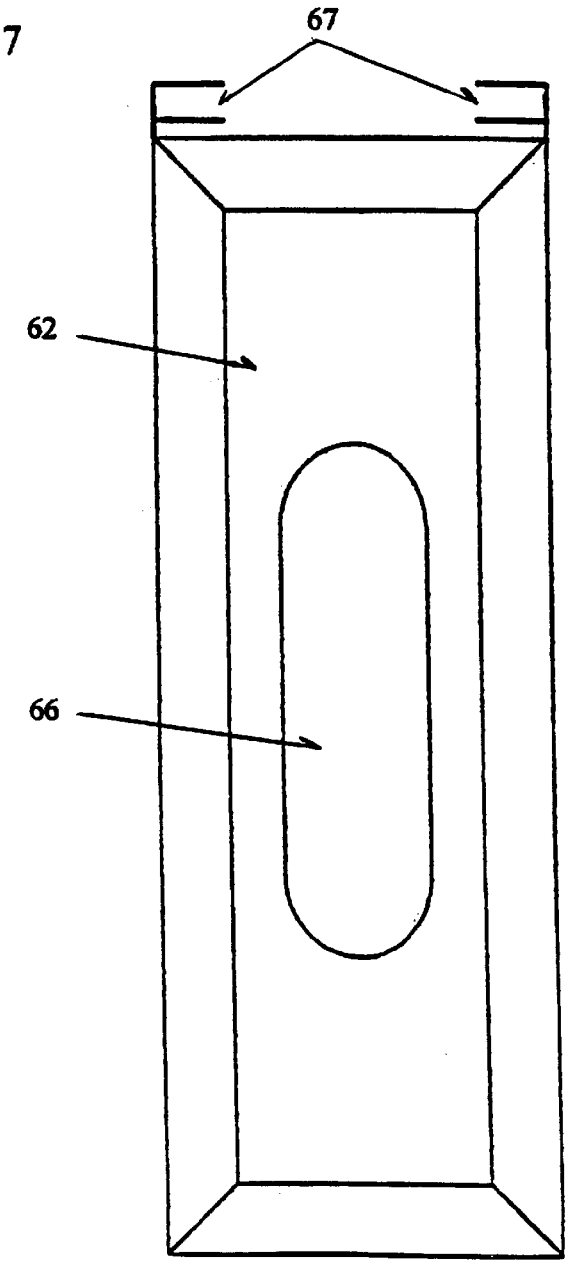
FIG. 6 is a top elevation of a means of closure to ensure retention of articles in holder regardless of position.

FIGS. 6 and 7 show two views of a means of closure to insure retention of the articles in the holder regardless of position of the holder. FIG. 6 shows a top view of this means comprising two channels 67 formed as an extension onto the surface of the holder on side panel 54 which accepts the body of the articles to be stored. FIG. 7 shows a side view of this means including a panel 68 which fits into the channels 67 of FIG. 6. The panel 68 is slid down the channels to the base of the holder when necessary to ensure retention of the articles in the holder, such as when the holder is in transit. A means of latching the panel at the base is specified. The panel 68 is slid upward in the channels 67 to allow access to the articles in the holder.

Figure 8:
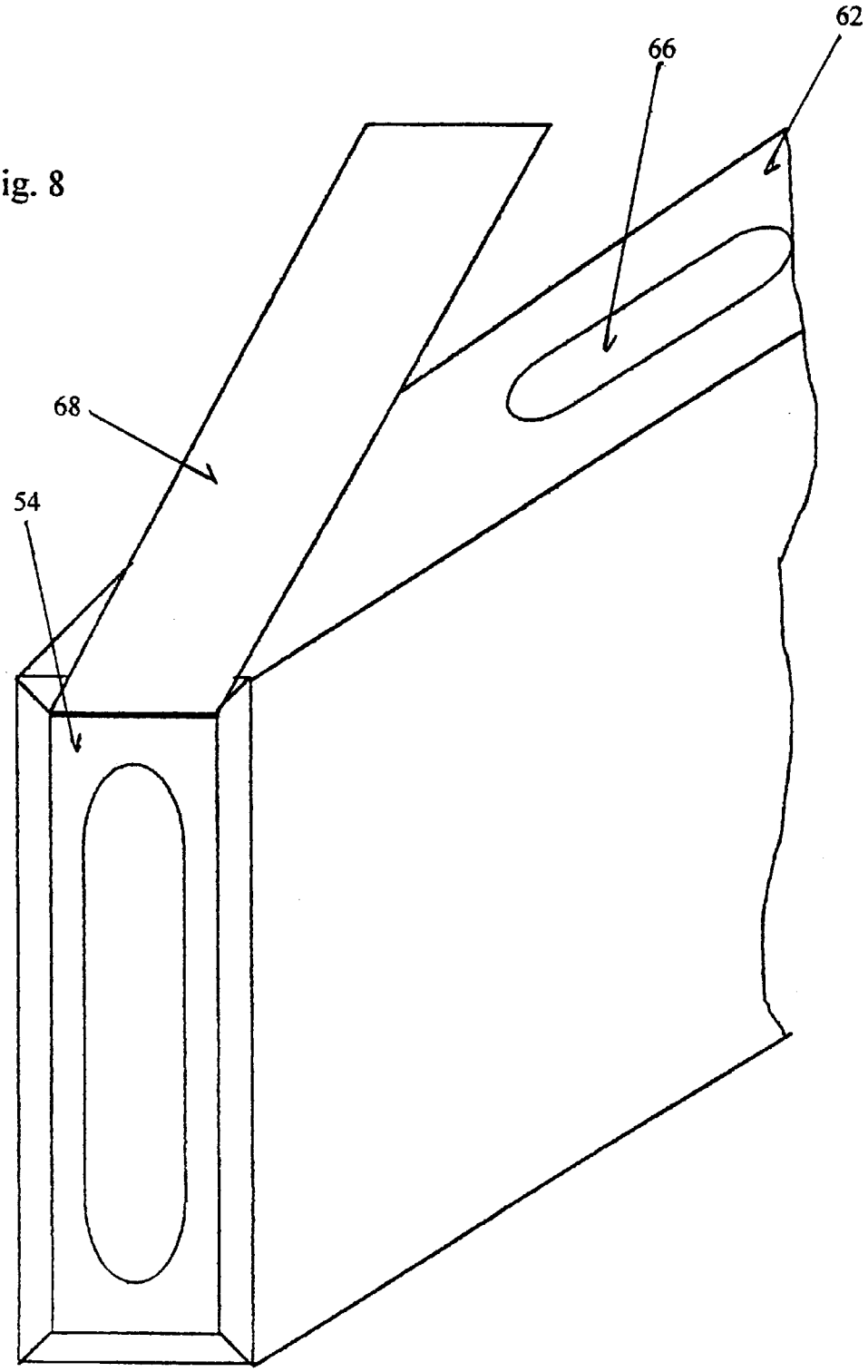
FIG. 8 is a side elevation of a second means of closure to ensure retention of articles in holder regardless of position.

FIG. 8 is a side view of a second means of closure to insure retention of the articles within the holder. A panel 68 is hinged at one end to the top of side panel 54. The panel 68 is pivoted upward away from side panel 54 to allow access to the articles within the holder and pivoted back to latch at the base to insure retention of the articles within the holder regardless of position. Though not illustrated herein, a variation on this means would include a closure panel pivoting on a rivet centered on the top of the panel allowing for the pivoting of the closure panel on the same plane as the side panel.

Figure 9:
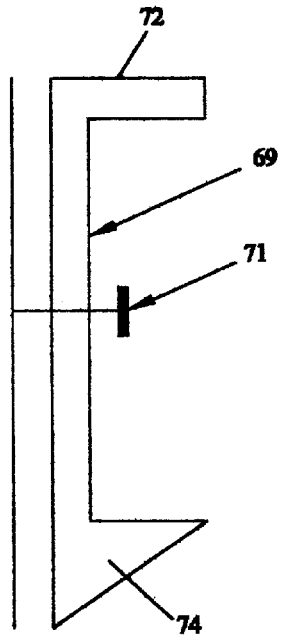
FIG. 9 is a side view of a means of linking two or more holders.
Figure 10:
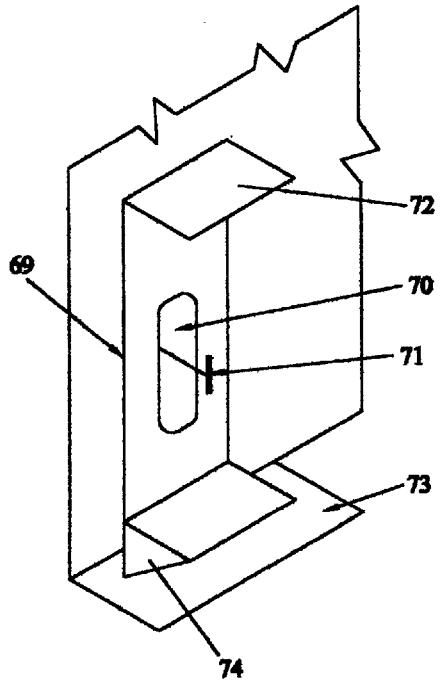
FIG. 10 is a front view of a means of linking two or more holders.

FIGS. 9 and 10 show a means of linking two or more holders to increase the storage capacity of the articles. FIG. 9 is a side view of this means and FIG. 10 is a front view comprising a tab 69 with a longitudinal slot 70 cut into the surface which allows the tab 69 to slide up or down. A peg 71 extending through the slot 70 retains the tab to the surface of the holder. These tabs may be mounted on the inside of the sides of the holder at the base. An accommodation 72 for thumb or finger on the upper end of the tab allows the tab to be slid downward through a cutout 73 in the base of the holder. The triangular base 74 of the tab is formed with a flat surface at right angle to the tab.

Upon positioning the base of one holder over the top side panel of another holder, the tab 69 is slid downward though the cutout 73 in the base of the holder. A receiving cutout on the top of a second holder is positioned to allow the passage of the triangular base 74 of the tab, yet so aligned as to engage the flat surface of the triangular base on the tab with the underside surface of the top panel of the second holder, thereby linking two holders. A sufficient number of these tabs are employed so as to insure the secure linking of the holders.

It is understood that the representations of the principles of the present invention described herein may take a variety of forms upon manufacture. As the qualities and attributes of the materials of manufacture limit and define the qualities and attributes of the manufactured item, so the form of the manufactured representation of the idea or invention may reflect these limitations and definitions accordingly. The representations included herein are not intended to limit the variety of forms the idea represented by this invention may embody.

What is claimed is:

1. A holder for tube shaped articles having a narrow end and a larger end comprising:

a slanted base directing a downward orientation to the articles held within, allowing for removal of articles from any position in the holder independent of other articles in the holder, including a means of securing said holder to a surface while allowing for the removal of the holder from said surface for portability of the holder and it's contents;

first and second sides opposing each other on the base including a means of interlocking two or more holders to exponentially increase the storage capacity of the articles:

the first side having a slot for permitting insertion and withdrawal of articles through the slot as well as a means of closure to retain the articles in the holder regardless of the position of the holder;

the second or opposing side having a slot sufficient to accommodate the narrow end of an article while not allowing the passage of the larger end of the article thereby retaining the articles within the holder;

a top side comprising:

a panel attached to the side panels at a spaced distance from the base allowing articles to be stacked within the holder and limiting how man articles can be stored relative to it's distance from the base with a means of allowing portability of the rack;

a back side comprising:

at least a partial panel linking the aforementioned sides including a means of securing said holder to horizontal or vertical surfaces while allowing for ease of removal of the rack from it's mounting for portability;

a front side:

to allow the articles within the holder to be viewed.

2. The holder of claim 1, wherein the back side panel and the base are extended beyond said second side thereby providing a surface to accommodate potential spillage while the holder is in an upright position or laying flat.

* * * * *